US006359207B1

(12) United States Patent
Oba et al.

(10) Patent No.: US 6,359,207 B1
(45) Date of Patent: Mar. 19, 2002

(54) POSITION TRANSDUCER SYSTEM WITH BUILT-IN CALIBRATOR FOR MOVING OBJECT, METHOD FOR ACCURATELY DETERMINING POSITION OF MOVING OBJECT AND KEYBOARD MUSICAL INSTRUMENT EQUIPPED WITH THE POSITION TRANSDUCER SYSTEM

(75) Inventors: Yasuhiko Oba; Yuji Fujiwara; Tsutomu Sasaki; Shigeru Muramatsu, all of Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/421,860

(22) Filed: Oct. 20, 1999

(30) Foreign Application Priority Data

Oct. 23, 1998 (JP) ..... 10-302949

(51) Int. Cl.[7] ..... G10H 5/00

(52) U.S. Cl. ..... 84/658; 84/20; 84/626; 84/462

(58) Field of Search ..... 84/20–23, 462, 84/626, 658, 461

(56) References Cited

U.S. PATENT DOCUMENTS

| | | | | |
|---|---|---|---|---|
| 5,001,339 A | | 3/1991 | Starkey et al. | |
| 5,451,708 A | * | 9/1995 | Fujiwara et al. | 84/21 |
| 5,530,198 A | * | 6/1996 | Ishii | 84/21 |
| 5,731,530 A | * | 3/1998 | Fujiwara et al. | 84/21 |
| 5,783,765 A | * | 7/1998 | Muramatsu | 84/626 |
| 5,824,930 A | * | 10/1998 | Ura et al. | 84/462 |
| 5,880,393 A | * | 3/1999 | Kaneko et al. | 84/21 |
| 5,922,983 A | * | 7/1999 | Muramatsu | 84/626 |
| 5,977,466 A | * | 11/1999 | Muramatsu | 84/440 |
| 6,051,762 A | * | 4/2000 | Fujiwara et al. | 84/21 |

FOREIGN PATENT DOCUMENTS

JP 9-54584 2/1997

* cited by examiner

*Primary Examiner*—Marlon T. Fletcher
(74) *Attorney, Agent, or Firm*—Ostrolenk, Faber, Gerb & Soffen, LLP

(57) ABSTRACT

A silent automatic player piano calibrates the black/white keys so as to exactly relate a key position signal to the current key positions on the trajectory of the key by itself before a recording so that the key motions are exactly recognized in a recording operation by the silent automatic player piano.

9 Claims, 12 Drawing Sheets

POSITION TRANSDUCER SYSTEM WITH BUILT-IN CALIBRATOR FOR MOVING OBJECT, METHOD FOR ACCURATELY DETERMINING POSITION OF MOVING OBJECT AND KEYBOARD MUSICAL INSTRUMENT EQUIPPED WITH THE POSITION TRANSDUCER SYSTEM

FIELD OF THE INVENTION

This invention relates to position-to-signal converting technology and, more particularly, to a position transducer system with a built-in calibrator for moving objects, a method for exactly determining the position of a moving object and a keyboard musical instrument equipped with the position transducer system.

DESCRIPTION OF THE RELATED ART

While a pianist is playing a piano, he or she selectively depresses the black/white keys and, thereafter, releases them so as to generate acoustic tones. The depressed black/white key actuates the associated damper mechanism and the associated key action mechanism. The depressed black/white key lifts the damper felt, and the damper felt is spaced from the associated set of strings so as to allow the set of strings to vibrate. On the other hand, the key action mechanism drives the associated hammer to rotate, and the hammer felt strikes the set of strings. Then the strings vibrate to generate the acoustic tone. When the pianist releases the depressed black/white key, the black/white key returns toward the rest position. The released black/white key brings the damper felt into contact with the set of strings, again, and damps the vibrations of the set of strings. This extinguishes the acoustic tone. If the pianist depresses pedals, i.e., a damper pedal, a sustaining pedal and a soft pedal, the pedal mechanisms impart predetermined effects to the acoustic tones. Thus, the acoustic piano repeats the loop having depressing a black/white key, striking the strings, releasing the black/white key and damping the vibrations during the performance, and the pedals selectively impart the expressions to the acoustic tones.

An automatic player piano is an acoustic piano equipped with a recording system and a playback system. While a pianist is playing the acoustic piano, each of the black/white keys generates the acoustic tone through the above-described steps, and the pedal mechanisms selectively impart the expressions to the acoustic tones. The recording system monitors the black/white keys so as to generate pieces of music data information representative of the performance. The pieces of music data information are stored in a suitable information storage medium. Otherwise, a tone generator and a sound system produce electronic sounds on the basis of the pieces of music data information in a real time fashion. When the pianist instructs the automatic player piano to reproduce the performance, the playback system reads out the pieces of music data information from the information storage medium, and the actuators selectively actuate the black/white keys and the pedals.

An automatic player piano may be equipped with a silent system. The silent system includes a hammer stopper, which is usually provided between the hammer shanks and the sets of strings. The hammer stopper is adjustable between a free position and a blocking position. While a pianist is playing a tune on the keyboard, the black/white keys are selectively depressed, and the hammer assemblies escape from the associated jacks. Then, the hammer assembly associated with a depressed key starts to rotate freely. The hammer stopper in the free position allows the hammer to strike the set of stings, and the strings vibrate to generate an acoustic tone. However, if the hammer stopper is in the blocking position, the hammer assembly rebounds on the hammer stopper before striking the strings, and no acoustic tone is generated. A key sensor monitors the associated black/white key, and reports the key motion to a tone generator. The tone generator produces a tone signal, and an electronic sound is reproduced through a headphone.

An automatic player piano may be equipped with a silent system. The silent system includes a hammer stopper, which is usually provided between the hammer shanks and the sets of strings. The hammer stopper is changed between a free position and a blocking position. While a pianist is playing a tune on the keyboard, the black/white keys are selectively depressed, and the hammer assemblies escape from the associated jacks. Then, the hammer assembly associated with a depressed key starts a free rotation. The hammer stopper in the free position allows the hammer to strike the set of strings, and the strings vibrate for generating an acoustic tone. However, if the hammer stopper is in the blocking position, the hammer assembly rebounds on the hammer stopper before striking the strings, and any acoustic tone is not generated. A key sensor monitors the associated black/white key, and reports the key motion to a tone generator. The tone generator produces a tone signal, and an electronic sound is reproduced through a headphone.

A shutter plate attached to the associated key and a photo sensor mounted on the key bed form in combination a typical example of the key sensor. However, the prior art key sensor merely detects a couple of points on the trajectory of the associated key, and a data processor calculates the key velocity on the basis of the distance between the detecting points and a lapse of time therebetween.

Another prior art key sensor available for an automatic player piano is disclosed in Japanese Patent Publication of Unexamined Application (laid-open) No. 9-54584. The prior art key sensor continuously detects the key moving on a trajectory.

An opto-electronic sensing device is disclosed in U.S. Pat. No. 5,001,339, assigned to Gulbransen Incorporated. The opto-electronic sensing device is also available for detecting a key motion of an acoustic piano. The opto-electronic sensing device has a flag held in contact with the lower surface of the key at all times, and an opto-electronic sensor monitors the flag so as to generate an output signal indicative of the current position of the flag and, accordingly, the key.

The prior art key sensor disclosed in the Japanese Patent Publication of Unexamined Application needs to eliminate noise components due to individualities of the key sensor and a fitting error from the output signal. For this reason, calibration is required. The prior art key sensors are respectively calibrated at the rest positions of the associated keys, only. However, there is a difference between the black keys and the white keys, and the individualities are still left after the calibration. For this reason, the calibration is imperfect, and the prior art key sensors do not accurately detect the current key positions.

On the other hand, the prior art key sensor disclosed in the aforementioned U.S. Patent is of the type having the flag held in contact with the associated key at all times. The key motion is transferred through the key action mechanism to the hammer, and the key action mechanism gives the unique key touch to the pianist at the escape of the jack from the hammer. The unique key touch is faint. The flag exerts the reaction against the depressed key, and the reaction damages the unique key touch. This is the first problem inherent in the prior art key sensor disclosed in the aforementioned U.S. Patent. The second problem is low accuracy. The prior art key sensor has position-to-potential converting characteristics, which are hardly represented by a linear line. The prior art key sensor does not accurately determine the current key position due to the non-linear converting characteristics.

Another problem inherent in both prior art key sensors is aged-based deterioration. Even if the manufacturer exactly calibrates the prior art key sensors, the actual position-to-voltage converting characteristics vary with time, and the key position becomes unreliable.

SUMMARY OF THE INVENTION

It is therefore an important object of the present invention to provide a position transducer system, which accurately recognizes the motion of a moving object.

It is also an important object of the present invention to provide a method for determining the position of a moving object which is used in a position transducer system.

It is also an important object of the present invention to provide a keyboard musical instrument, which accurately detects current positions of moving objects through the position transducer system.

In accordance with one aspect of the present invention, there is provided a position transducer system for determining a current position of a moving object movable along a trajectory, and the position transducer system comprises a non-contact type sensor monitoring the moving object and converting the current position of the moving object to a signal, a calibrator moving the movable object under standard conditions, connected to the non-contact type sensor and analyzing the signal for determining a relation between values of the signal and actual positions of the moving object and a corrector connected to the non-contact type sensor for receiving the signal and determining the current position of the moving object on the basis of the relation.

In accordance with another aspect of the present invention, there is provided a method for determining a current position of an object, comprising the steps of a) moving the object along a trajectory under standard conditions so as to obtain values of a signal representative of current positions on the trajectory, b) determining a relation between the values of the signal and the current positions and c) determining an actual position of the object moved under different conditions by comparing the value of the signal at the actual position with the values in the relation.

In accordance with yet another aspect of the present invention, there is provided a keyboard musical instrument comprising plural manipulators movable along respective trajectories between respective home positions and respective limit positions, a sound generating system generating sounds, and changing an attribute of the sounds depending upon the plural manipulators selectively depressed from the home positions, a position transducer system including plural non-contact type sensors respectively monitoring the plural manipulators and respectively converting the current positions of the associated manipulators to signals, a calibrator selectively moving the plural manipulators under standard conditions, connected to the non-contact type sensors and analyzing the signals for determining a relation between values of the associated signal and actual positions of each manipulator and a corrector connected to the non-contact type sensors for receiving the signals and determining the current positions of the plural manipulators on the basis of the relation and a controller connected between the corrector and the sound generating system, and responsive to the current positions determined by the corrector so as to instruct the sound generating system to change the attribute of the sounds.

BRIEF DESCRIPTION OF THE DRAWINGS

The features and advantages of the position transducer, the method and the keyboard musical instrument will be more clearly understood from the following description taken in conjunction with the accompanying drawings in which.

DESCRIPTION OF THE PREFERRED EMBODIMENT

Figure 1:
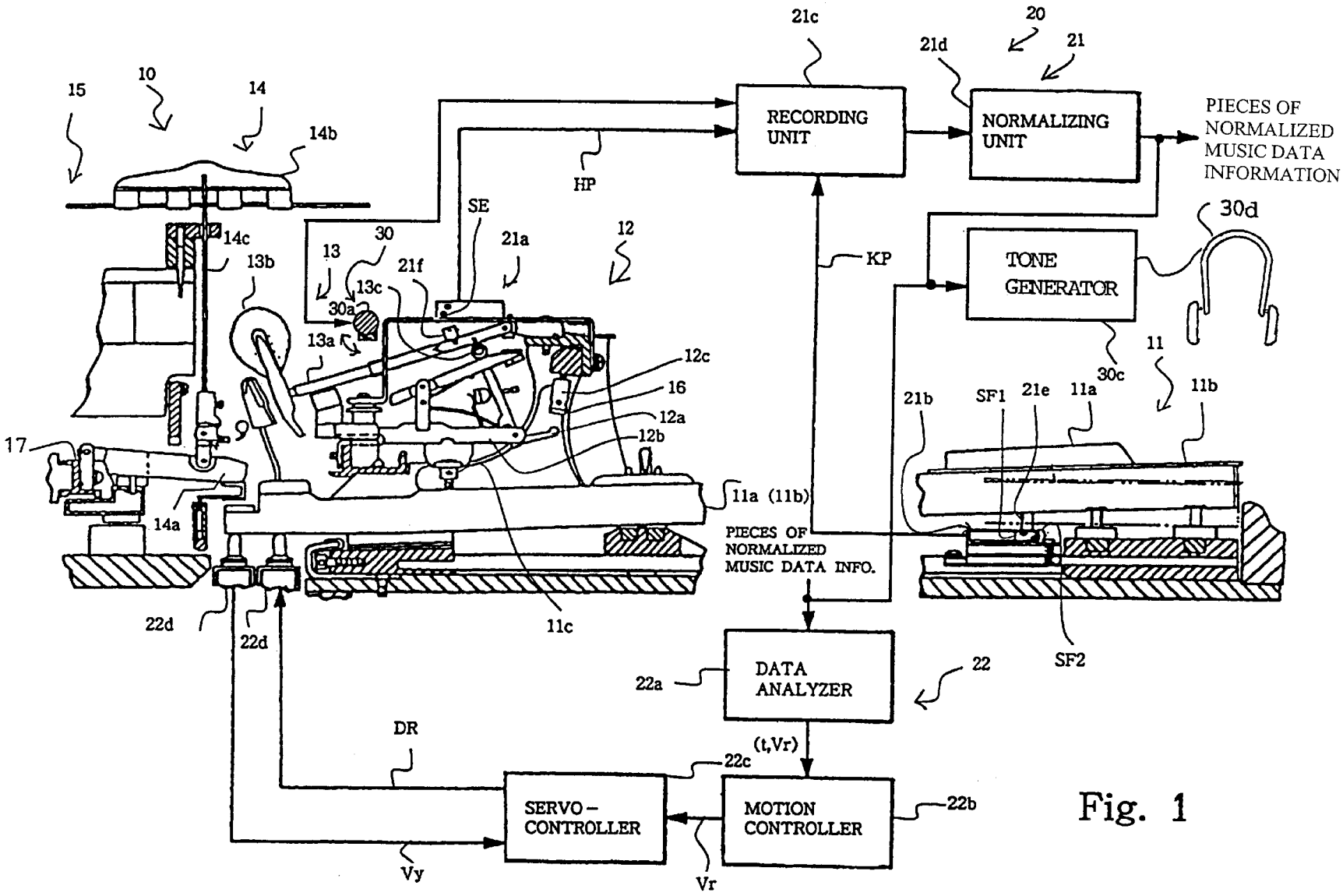
FIG. 1 is a schematic view showing the arrangement of a silent automatic player piano according to the present invention.

Referring to FIG. 1 of the drawings, a silent automatic player piano embodying the present invention largely comprises an acoustic piano 10, an automatic playing system 20 and a silent system 30. In this instance, the acoustic piano 10 is a grand piano. However, an upright piano is available for the automatic player piano according to the present invention. In the following description, term "front" means a position closer to a pianist than a "rear" position.

The acoustic piano 10 is broken down into a keyboard 11, key action mechanisms 12, hammer assemblies 13, damper mechanisms 14, sets of strings 15 and pedal mechanisms (not shown). Black keys 11*a* and white keys 11*b* are laid on the well-known pattern, and form in combination the keyboard 11. In this instance, eighty-eight black/white keys 11*a*/11*b* form in combination the keyboard 11. The self-weight of each black/white key 11*a*/11*b* keeps the black/white key 11*a*/11*b* at a rest position. When force is exerted on the front portion of the black/white key 11*a*/11*b*, the black/white key 11*a*/11*b* is downwardly moved, and reaches an end position.

The key action mechanisms 12 are respectively associated with the black/white keys 11*a*/11*b*. The key action mechanism 12 includes a jack 12*a* turnable around a whippen assembly 12*b* and a regulating button 12*c*. Each of the hammer assemblies 13 is associated with one of the key action mechanisms 12 and one of the sets of strings 15. The hammer assemblies 13 are driven for rotation by the associated key action mechanisms 12 actuated by the black/white keys 11*a*/11*b*, respectively. The hammer assembly 13 includes a hammer shank 13*a* turnable with respect to action brackets 16, a hammer head 13*b* attached to the leading end of the hammer shank 13*a* and a hammer roller 13*c* connected to the hammer shank 13*a*. When the associated black/white key 11*a*/11*b* is in the rest position, the hammer roller 13*c* is held in contact with the jack 12*b*. Each of the damper mechanisms 14 is associated with one of the black/white keys 11*a*/11*b* and one of the sets of strings 15, and the associated black/white key 11*a*/11*b* spaces the damper mechanism 14 from and bring it into contact with the associated set of strings 15. The damper mechanism 14 includes a damper lever 14*a* turnable with respect to a damper rail 17 a damper head 14*b* spaced from and brought into contact with the associated set of strings 15 and a damper wire 14*c* connected between the damper lever 14*a* and the damper head 14*b*.

A capstan button 11*c* projects from the rear portion of each black/white key 11*a*/11*b*, and is held in contact with the whippen assembly 12*b*. While the black/white key 11*a*/11*b* is being depressed from the rest position toward the end position, the capstan button 11*c* upwardly pushes the whippen assembly 12*b*, and the whippen assembly 12*b* turns in the counter clockwise direction together with the jack 12*a*. The black/white key 11*a*/11*b* further pushes the damper lever 14*a* upwardly, and causes the damper lever 14*a* to turn in the counter clockwise direction. The damper lever 14*a* lifts the damper head 14*b*, and the damper head 14*b* is separated from the set of strings 15. The set of strings 15 is ready for vibrations.

The jack 12*a* is brought into contact with the regulating button 12*c* at the toe thereof, and turns in the clockwise direction around the whippen assembly 12*b*. Then, the hammer roller 13*c* escapes from the jack 12*a*, and the hammer assembly 13 starts a free rotation toward the associated set of strings 15. The hammer head 13*b* strikes the set of strings 15, and the strings 15 vibrate for generating an acoustic tone.

When the depressed black/white key 11*a*/11*b* is released, the black/white key 11*a*/11*b* starts to return to the rest position, and allows the damper lever 14*a* to turn in the clockwise direction. The damper head 14*b* is brought into contact with the set of strings 15, again, and damps the vibrations of the strings 15. Thus, the acoustic piano 10 generates the acoustic tone similar to a standard grand piano.

The automatic playing system 20 is broken down into a recording sub-system 21 and a playback sub-system 22. The recording sub-system 21 comprises plural hammer sensors 21*a* respectively associated with the hammer assemblies 13, plural key sensors 21*b* respectively associated with the black/white keys 11*a*/11*b*, a recording unit 21*c* connected to the hammer sensors 21*a* and the key sensors 21*b* for generating pieces of music data information and a normalizing unit 21*d* for producing pieces of normalized music data information.

Each of the key sensors 21*b* has a shutter plate 21*e* attached to the lower surface of the associated black/white key 11*a*/11*b* and a photo sensor SF1. The photo sensor SF1 forms a part of a photo sensor matrix (see FIG. 3), and monitors the associated black/white key 11*a*/11*b* over the trajectory between the rest position and the end position. The photo sensor SF1 is connected to the recording unit 21*c*, and supplies a key position signal KP to the recording unit 21*c*. The recording unit 21*c* determines a depressing time tk at which a player depresses the black/white key 11*a*/11*b*, a depressed key velocity Vk on the way toward the end position, a releasing time at which the black/white key 11*a*/11*b* is released and a release key velocity on the way toward the rest position.

Each of the hammer sensors 21*a* has a shutter plate 21*f* and a photo sensor SE, and the photo sensor SE is connected to the recording unit 21*c* so as to supply a hammer position signal HP thereto. The recording unit 21*c* calculates a shutter velocity and, accordingly, a hammer velocity on the basis of the hammer position signal HP, and determines a time of intersecting the optical path to be an impact time at which the hammer head 13*b* is assumed to strike the associated set of strings 15 for generating the acoustic tone. Thus, the recording unit 21*c* generates pieces of music data information representative of the performance, and the pieces of music data information are supplied to the normalizing unit 21*d*. The normalizing unit 21*d* eliminates the individuality of the silent automatic player piano from the pieces of music data information, and produces pieces of normalized music data information from the pieces of music data information. The pieces of normalized music data information are stored in a suitable data storage (not shown) such as, for example, a floppy disk, a hard disk, an optical disk or a semiconductor memory device, and/or are transferred through a data communication network (not shown).

The playback sub-system 22 includes a data analyzer 22*a*, a motion controller 22*b*, a servo-controller 22*c* and solenoid-operated key actuators 22*d*. Velocity sensors are incorporated in the solenoid-operated key actuators 22*d*, respectively, and supply plunger signals Vy representative of actual velocity of the plungers to the servo-controller 22*c*. Pieces of normalized music data information representative of a performance are supplied from the data storage (not shown) or a real-time communication system (not shown) to the data analyzer 22*a*. The data analyzer 22*a* analyzes the pieces of normalized music data information, and determines a target key velocity Vr on a trajectory of each black/white key 11*a*/11*b* to be reproduced in the playback, and the target key velocity Vr is varied with time t. Thus, the data analyzer 22*a* produces a series of target key velocity data (t, Vr) from the pieces of normalized music data information, and supplies the series of target velocity data (t, Vr) to the motion controller 22*b*. The motion controller 22*b* determines the target key velocity varied together with the key position on the trajectory of the black/white key 11*a*/11*b*, and instructs an amount of driving current appropriate to the target key velocity Vr to the servo-controller 22*c* for each of the black/white keys 11*a*/11*b* to be moved. The servo-controller 22*c* is responsive to the instruction of the motion controller 22*b* so as to supply a driving signal DR to the solenoid-operated key actuator 22*d* associated with the black/white key 11*a*/11*b* to be moved. While the solenoid-operated key actuator 22*d* is projecting the plunger thereof, the associated black/white key 11*a*/11*b* is moved so as to actuate the associated key action mechanism 12, and the velocity sensor reports the actual plunger velocity Vy to the servo-controller 22*c*. The servo-controller 22*c* compares the actual plunger velocity Vy with the target key velocity, i.e., the target plunger velocity to see whether or not the actual plunger velocity Vy is equal to the target key velocity Vr. If the actual plunger velocity Vy is different from the target key velocity Vy, the servo-controller 22*c* increases or decreases the amount of current.

The silent system 30 includes a shank stopper 30*a,* an electric motor (not shown) connected to the shank stopper 30*a,* a position sensor 30*b* (see FIG. 2) for detecting the current position of the shank stopper 30*a,* a tone generator 30*c* and a sound system such as a headphone 30*d* and a speaker system 30*e.* When a pianist manipulates a switch, the electric motor changes the shank stopper 30*a* between a free position and a blocking position. The hammer shanks 13*a* rebound on the shank stopper 30*a* in the blocking position before the hammer heads 13*b* strike the associated sets of strings 15. On the other hand, when the shank stopper 30*a* is in the free position, the hammer heads 13*b* strike the associated sets of strings 15 without any interference of the shank stopper 30*a.* Thus, the silent system 30 allows the pianist to finger on the keyboard 11 without acoustic tones. While the player is playing a tune on the keyboard 11, the electronic signal generator 30*c* produces an audio signal from the pieces of normalized music data information each representative of a key code, a velocity, a key-on event, a hammer-on event, a key-off event etc., and supplies the audio signal to the headphone 30*d.* Then, the headphone 30*d* generates electronic sounds corresponding to the acoustic tones to be generated by the strings 15. In the following description, a performance without any interference of the shank stopper 30*a* is referred to as "standard performance", and a performance under the shank stopper 30*a* in the blocking position is referred to as "silent performance".

Figure 2:
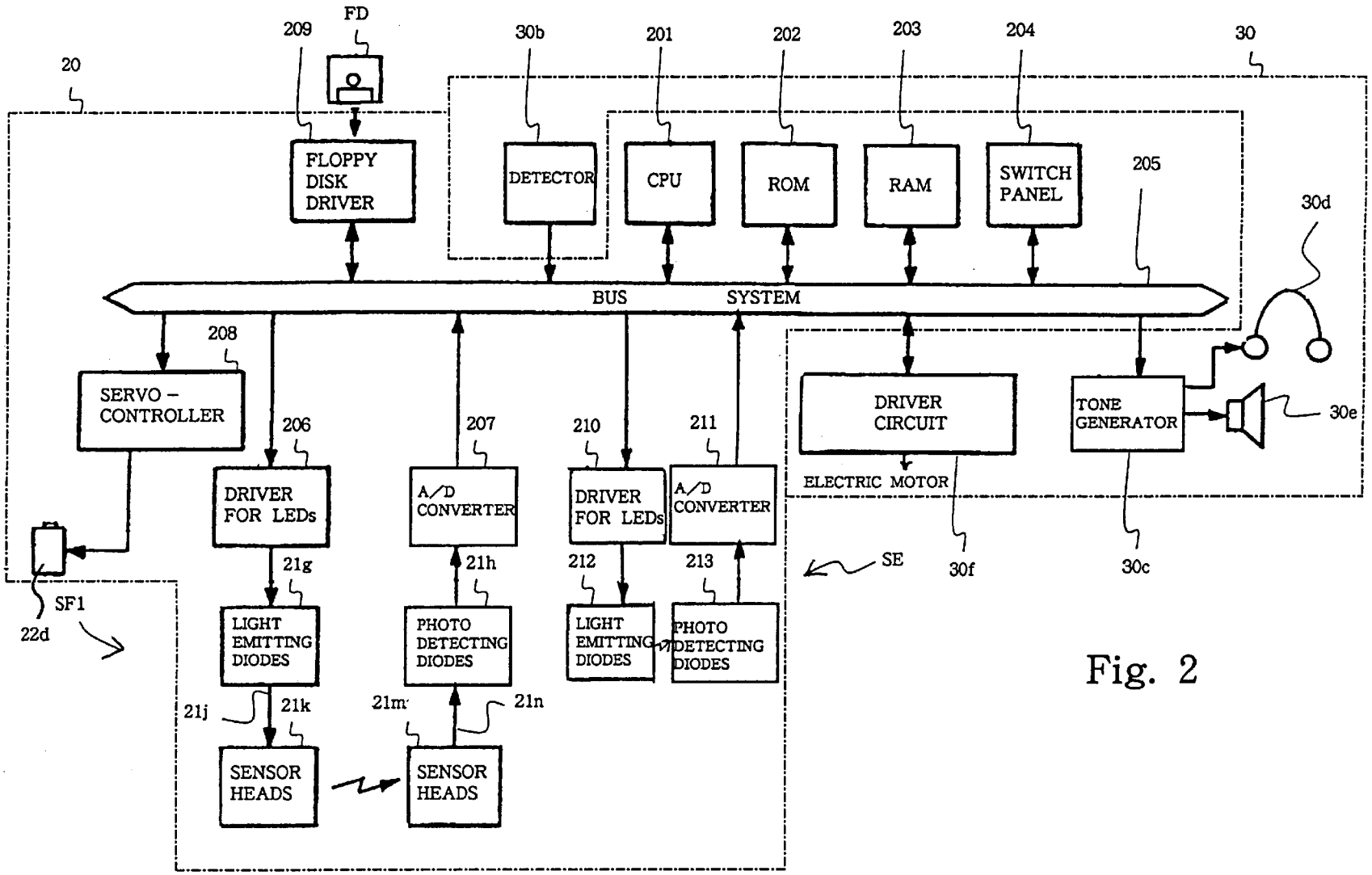
FIG. 2 is a block diagram showing the circuit arrangement of an automatic playing system and a silent system.

FIG. 2 illustrates the arrangement of the automatic playing system 20 and the silent system 30. The automatic playing system 20 includes a central processing unit 201, a read only memory 202 and a random access memory 203, which are respectively abbreviated as "CPU", "ROM" and "RAM" in FIG. 2. Computer programs and various tables are stored in the read only memory 202, and the random access memory 203 serves as a working memory. In this instance, the recording unit 21*c,* the normalizing unit 21*d,* the data analyzer 22*a* and the motion controller 22*b* are implemented by the central processing unit 201 and the computer programs.

The automatic playing system 20 further includes a manipulating switch panel 204, and a bus system 205 is connected to the central processing unit 201, the read only memory 202, the random access memory 203, the manipulating switch panel 204 and other system components described hereinbelow in detail. The central processing unit 201 sequentially fetches the instruction codes of the computer program, and executes them so as to produce pieces of music data information and instruct the other system components.

The automatic playing system 20 further includes a driver 206 for light-emitting diodes, an analog-to-digital converter 207, a servo-controller 208 and a floppy disk driver 209. The central processing unit 201 instructs the driver 206 to sequentially energize the light emitting diodes 21*g,* and the light is propagated through optical fibers 21*j* to sensor heads 21*k.* The light is incident onto sensor heads 21*m,* and the incident light is propagated through optical fibers 21*n* to the photo detecting diodes 21*h.* The photo detecting diodes 21*h* covert the light to photo current, and produce analog key position signals each representative of the amount of photo current. The amount of photo current is proportional to current key position of the associated black/white key 11*a*/11*b.* The analog key position signals are converted to digital key position signals KP, and the central processing unit 201 acquires pieces of data information representative of the amount of photo current and, accordingly, the current key positions. The eighty-eight black/white keys 11*a*/11*b* are divided into plural groups, and the driver 206 energizes the light emitting diodes 21*g* in such a manner that the photo sensors SF1/SF2 sequentially check the plural groups of black/white keys 11*a*/11*b.* For this reason, the central processing unit 201 can determine key codes assigned to the black/white keys 11*a*/11*b* presently checked by the photo sensors SF1 on the basis of the timing for selectively energizing the light emitting diodes 21*g.*

The floppy disk driver 209 is connected to the bus system 205. The floppy disk driver 209 writes pieces of music data information into and reads out the pieces of music data information from a floppy disk FD.

The automatic playing system 20 further includes a driver 210 for light emitting diodes connected to the bus system 205, an analog-to-digital converter 211 also connected to the bus system 205, light emitting diodes 212 selectively energized by the driver 210 and photo detecting diodes 213 converting incident light to photo current. The photo sensor SE is implemented by the combination of the light emitting diode 212 and the associated photo detecting diode 213.

A driver circuit 30*f* is connected to the bus system 205, and the central processing unit 201 instructs the driver circuit 30*f* to rotate the electric motor from the free position to the blocking position or the vice versa. The detector 30*b* monitors the hammer stopper 30*a.* When the hammer stopper 30*a* reaches the free position or the blocking position, the detector 30 reports the arrival at the free/blocking position to the central processing unit 201. Then, the central processing unit 201 instructs the driver circuit 30*f* to stop the electric motor.

Optical Sensor Head

Figure 3:
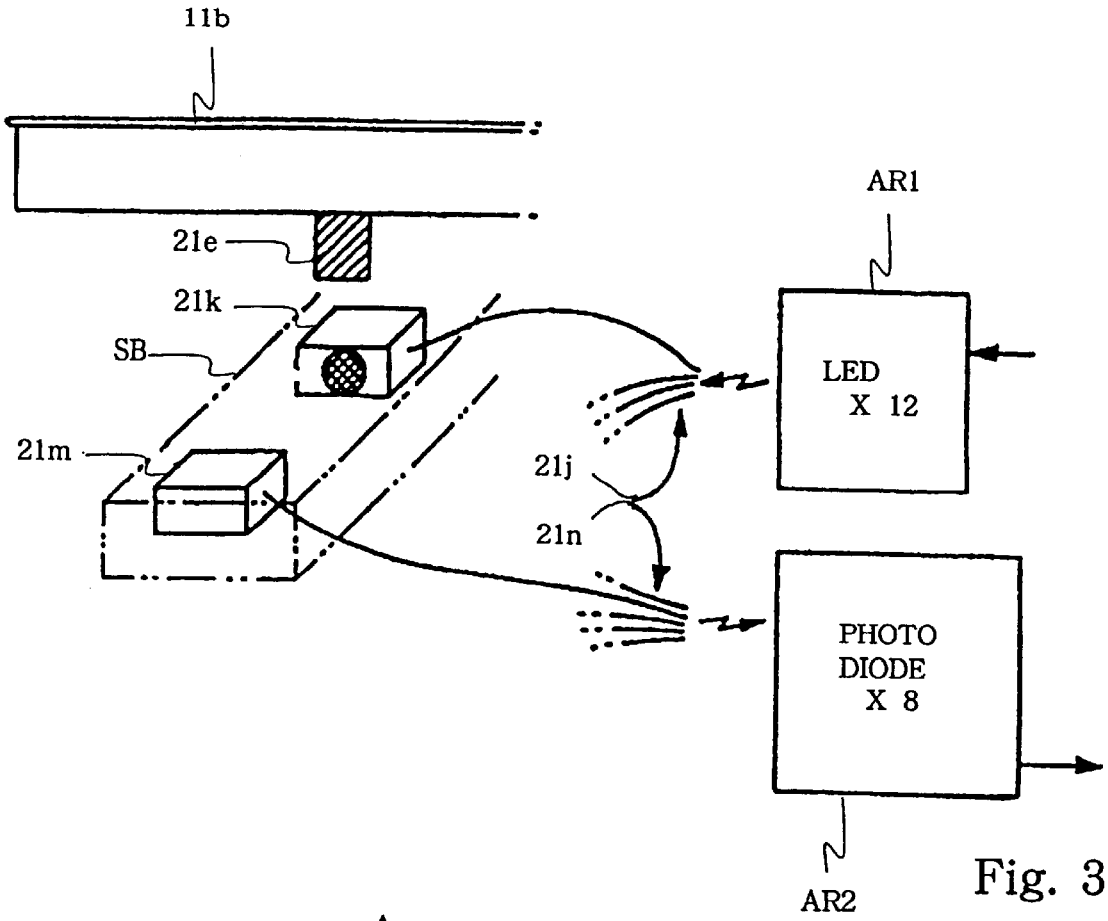
FIG. 3 is a schematic view showing a key sensor incorporated in the automatic player piano.

FIG. 3 illustrates the optical sensor matrix. Although the optical sensor matrix is used for eighty-eight black/white keys, only one white key 11*b* is shown in FIG. 3. The shutter plate 21*e* is attached to the lower surface of the white key 11*b,* and is hatched in FIG. 3 for the purpose of discrimination. The optical sensor matrix includes the light emitting sensor head 21*k,* the light receiving sensor head 21*m,* the light emitting diodes 21*g,* the photo detecting diodes 21*h* and the bundles of optical fibers 21*j* and 21*n.* The light emitting sensor head 21*k* and the light receiving sensor head 21*m* are fixed to a frame SB together with other light emitting sensor heads (not shown) and other photo detecting sensor heads (not shown), and are spaced from one another. Twelve light emitting diodes 21*g* form an array AR1, and eight photo-detecting diodes form an array AR2. One of the light emitting diodes 21*g* is connected through an optical fiber of the bundle 21*j* to the light emitting sensor head 21*k,* and the light receiving sensor head 21*m* is connected through an optical fiber of the bundle 21*n* to one of the photo detecting diodes 21*h.* Each of the light emitting diodes 21*g* is connected to eight optical fibers of the bundle 21*j,* and twelve optical fibers of the bundle 21*n* are connected to each photo detecting diode 21*h.* For this reason, eight light emitting sensor heads 21*k* concurrently radiate the eight optical beams, and the eight photo detecting diodes 21*h* simultaneously receive the light transferred from the associated light receiving sensor heads 21*m* through the optical fibers 21*n.* Although the combinations of the light emitting diodes 21*g* and the photo detecting diodes 21*h* are ninety-six, only eighty-eight combinations are used for the eight-eight black/white keys 11*a*/11*b.*

When the light emitting diode 21*g* is energized, the light emitting diode 21*g* generates light. The light is propagated through the optical fiber 21*j* to the light emitting sensor head 21*k*, and the light emitting sensor head 21*k* radiates a light beam to the light receiving sensor head 21*m* across the trajectory of the shutter plate 21*e*. The light beam is 5 millimeter in diameter. The light receiving sensor head 21*k* receives the light beam, and the incident light is propagated through the optical fiber 21*n* to the associated photo detecting diode 21*h*. The photo detecting diode 21*h* converts the light to the analog key position signal, and supplies the analog key position signal to the analog-to-digital converter 207.

The analog key position signal is representative of the amount of incident light. A player is assumed to depress the white key 11*b*. The white key 11*b* sinks toward the end position, and the shutter plate 21*e* gradually intersects the light beam. As a result, the amount of incident light is decreased, and, accordingly, the photo detecting diode 21*h* reduces the magnitude or the voltage of the analog key position signal.

Figure 4:
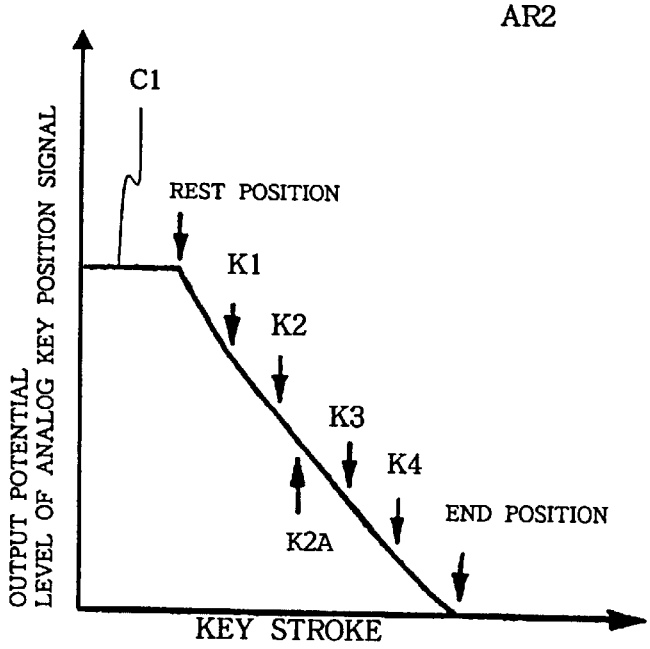
FIG. 4 is a graph showing a relation between a keystroke and an output potential level.

The position-to-voltage converting characteristics of the optical sensor matrix is represented by plots C1 in FIG. 4. The potential level of the analog key position signal linearly falls from the rest position to the end position. Detecting points K1, K2, K2A, K3 and K4 are determined so as to check the potential level of the analog key position signal as will be described hereinlater.

Data Correction

Description is hereinbelow made about a calibration process with reference to FIG. 5. In the following description, the standard key stroke is assumed to be 10 millimeters from the rest position to the end position.

A black/white key 11*a*/11*b* is maintained at the rest position. The central processing unit 201 instructs the driver 206 to energize the associated light emitting diode 21*g*, and fetches the digital key position signal KP representative of the rest position as by step S1. The binary number Yrest at the rest position is stored in a table defined in the random access memory 203.

Subsequently, the black/white key 11*a*/11*b* is depressed as by step S2, and is maintained at the end position. The central processing unit 201 fetches the digital key position signal representative of the end position as by step S3, and stores the binary number Yend at the end position is stored in the table defined in the random access memory 203.

Subsequently, the depressed black/white key 11*a*/11*b* is released, and returns toward the rest position at a predetermined key velocity such as, for example, 10 millimeters/second as by step S4. When the depressed black/white key 11*a*/11*b* starts to return toward the rest position, the central processing unit 201 instructs the driver 206 to energize the associated light emitting diode 21*g*, and periodically fetches the digital key position signal KP as by step S5. The central processing unit 201 stores the binary number Y in the table defined in the random access memory 203 as by step S6, and compares the binary number Y with the binary number Yrest to see whether or not the binary number Y is greater than the binary number Yrest as by step S7.

If the black/white key 11*a*/11*b* is on the way to the rest position, the answer at step S7 is negative, and the central processing unit 201 returns to step S5. Thus, the central processing unit 201 reiterates the loop consisting of steps S5, S6 and S7, and repeats the sampling on the trajectory of the black/white key 11*a*/11*b* toward the rest position. The timing for the sampling is represented by t, and the first sampling timing is tend=0. Plural sampling timings t are obtained between the first sampling timing tend and the last sampling timing trest. The central processing unit 201 is assumed to sample the digital key position signal KP at intervals of 10 millisecond, and the released key velocity is 10 millimeters/second. Then, the central processing unit 201 samples the digital key position signal KP at intervals of 0.1 millimeter.

When the black/white key 11*a*/11*b* reaches the rest position, the answer at step S7 is affirmative, and the central processing unit 201 approximates the binary numbers Yend, Y and Yrest to a linear line as by step S8. The linear line is a function of the sampling timing t. The central processing unit 201 converts the function to a function of the key stroke as by step S9. The first sampling timing tend and the last sampling timing trest are corresponding to a positional data xend and another positional data xrest, and the positional data xend and the positional data xrest are at the key stroke of 10 millimeters and at the key stroke of zero, respectively.

The binary number Y at the positional data xend and the binary number Y at the positional data xrest are determined to be an actual end position data Yend' and an actual rest position data Yrest' as by step S10. The central processing unit 201 checks the table to see whether or not the correction data have been already stored for all the black/white keys 11*a*/11*b* as by step S11. If the answer at step S11 is negative, the central processing unit 201 returns to step S1, and repeats the loop consisting of steps S1 to S11 so as to acquire the correction data for the other black/white keys 11*a*/11*b*. When the actual end position data Yend' and the actual rest position data Yrest' are stored for all the black/white keys 11*a*/11*b*, the answer at step S11 is affirmative, and the central processing unit 201 exits from the loop. The actual end position data Yend' and the actual rest position data Yrest' are the corrected data for the binary numbers Yend and Yrest, respectively.

The binary number Y at the positional data xend and the binary number Y at the positional data xrest are determined to be an actual end position data Yend' and an actual rest position data Yrest' as by step S10. The central processing unit 201 checks the table to see whether or not the correction data have been already stored for all the black/white keys 11*a*/11*b* as by step S11. If the answer at step S11 is given negative, the central processing unit 201 returns to step S1, and repeats the loop consisting of steps S1 to S11 so as to acquire the correction data for the other black/white keys 11*a*/11*b*. When the actual end position data Yend' and the actual rest position data Yrest' are stored for all the black/white keys 11*a*/11*b*, the answer at step S11 is given affirmative, and the central processing unit 201 exits from the loop. The actual end position data Yend' and the actual rest position data Yrest' are the corrected data for the binary numbers Yend and Yrest, respectively.

Correction of Data in Recording

Figure 6:
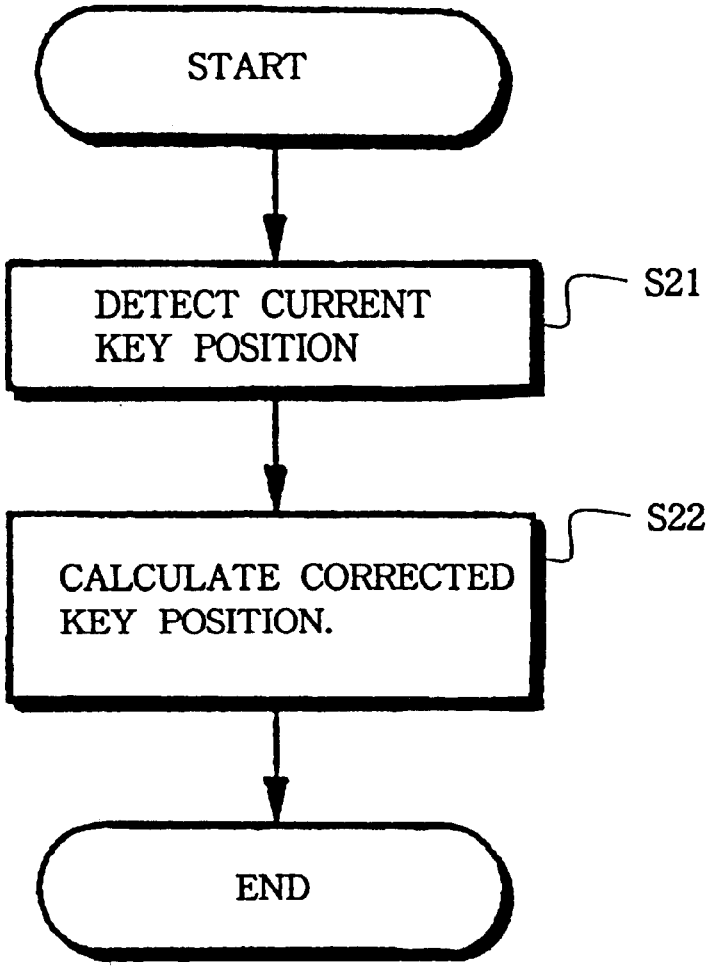
FIG. 6 is a flowchart showing a computer program for a correction of actual positional data during a recording operation.

FIG. 6 illustrates a computer program for correcting positional data during a recording. Assuming now that a player depresses a black/white key 11*a*/11*b* during a performance, the key sensor SF1 detects the current key position Y' as by step S21, and produces the digital key position signal KP representative of the current key position Y'. The central processing unit 201 samples the digital key position signal KP, and calculates the corrected key position Y" as by step S22. The corrected key position Y" is given as $$Y''YDrest+(YDend-YDrest)\times(Y'-Yrest')/(Yend'-Yrest')$$

where YDrest is a design value of the digital key position signal KP at the rest position and YDend is a design value of the digital key position signal KP at the end position. Thus, the current key position Y' is converted to the corrected key position Y" on the trajectory defined by the design values of the digital key position signal KP. The first reference key position K1 to the fourth reference key position K4 are also defined by using the design values of the digital key position signal KP, and the central processing unit 201 exactly determine whether or not the black/white key 11*a*/11*b* arrives at one of the first to fourth reference key positions K1 to K4.

Recording Operation

Firstly, description is made on a recording operation. While a pianist is playing a tune on the keyboard 11, the key sensors SF1 and the hammer sensors SE report the current key positions and the current hammer positions to the recording unit 21*c* through the digital key position signals KP and the digital hammer position signals HP. The recording unit 21*c* corrects the current key position Y' to Y" as described hereinbefore, and calculates the depressed key velocity and the released key velocity. The recording unit 21*c* further calculates the hammer velocity and the impact time on the basis of the digital hammer position signal HP.

The recording unit 21*c* produces pieces of music data information representative of the impact time, the hammer velocity, the depressed time, the depressed key velocity, the releasing time and the released key velocity for each reciprocal key motion. The recording unit 21*c* supplies the pieces of music data information to the normalizing unit 21*d,* and the normalizing unit 21*d* eliminates the individualities of the acoustic piano/ photo sensors 10/SF1/SE from the pieces of music data information. Thus, the normalizing unit 21*d* normalizes the pieces of music data information, and supplies the pieces of normalized music data information to the floppy disk driver 209. The pieces of normalized music data information are stored in the floppy disk 251.

Figure 7:
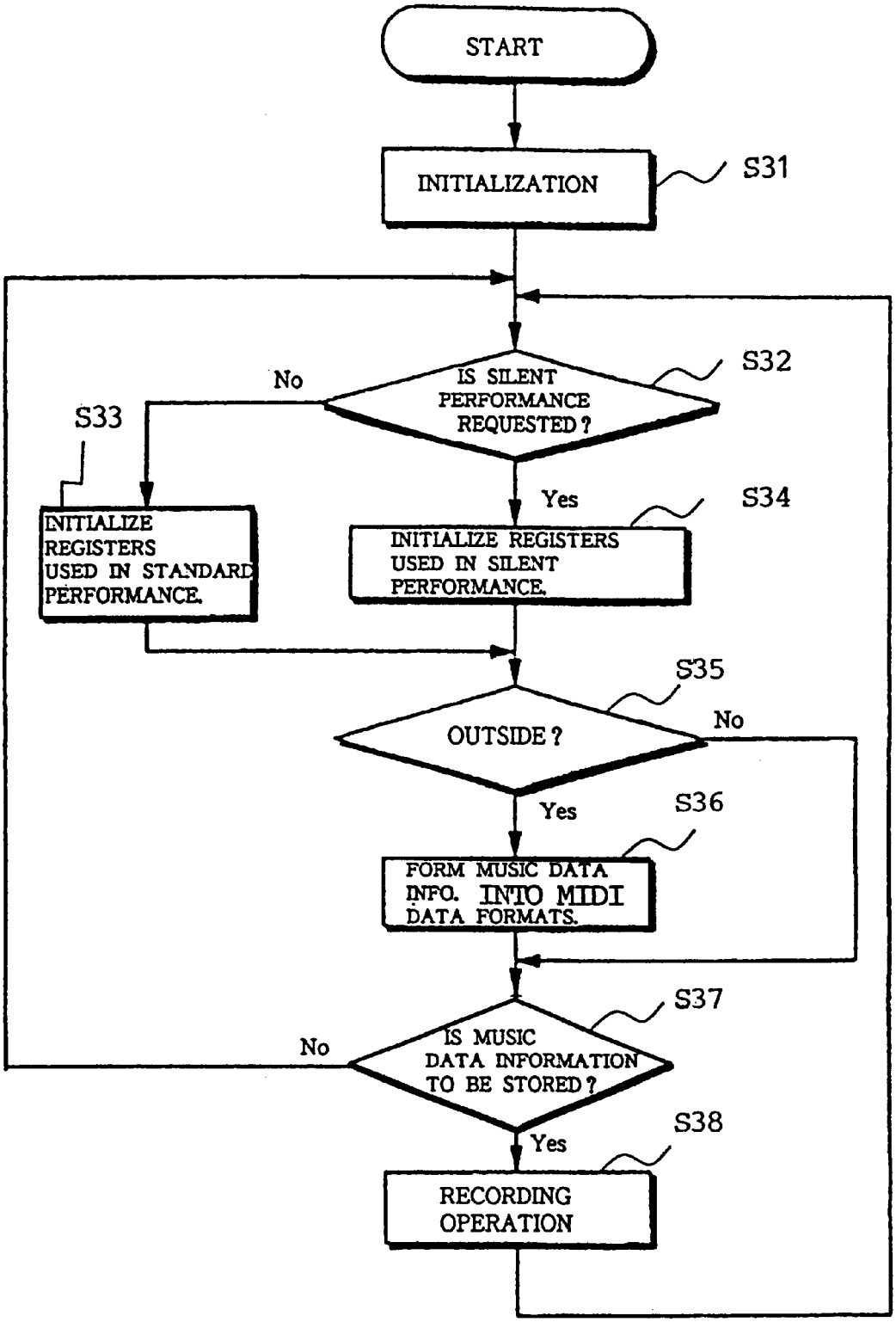
FIG. 7 is a flowchart showing a computer program for a recording operation.

FIG. 7 illustrates the computer program executed in the recording operation. When the recording unit 21*c* is powered, the central processing unit 201 initializes internal/ external registers (not shown) and other data storage, and changes the shank stopper 30*a* to the free position, if necessary, as by step S31. The pianist gives various instructions to the recording system 21 through the switch panel 204.

Subsequently, the central processing unit 201 checks the instructions to see whether or not the player instructed the silent system 30 to change the shank stopper 30*a* to the blocking position as by step S32. If the pianist wants the standard performance, the central processing unit 201 proceeds to step S33, and initializes the registers used in the standard performance. If the registers used in the standard performance have been already initialized, the central processing unit 201 skips step S33.

On the other hand, if the pianist wants the silent performance, the central processing unit 201 initializes registers used in the silent performance, and changes the shank stopper 30*a* to the blocking position as by step S34. The central processing unit 201 further changes a key-on timing. In the silent performance, the hammer assembly 13 rebounds on the hammer stopper 30*a*. If the impact timing is determined on the basis of the hammer position signal HP, the impact timing becomes earlier than a true impact timing at which the hammer is to strike the strings 15. In this instance, the central processing unit 201 estimates the actual impact timing on the basis of the impact timing and the hammer velocity both determined from the hammer position signal HP. In detail, a table is stored in the read only memory 202, and defines a relation between the hammer velocity and a time delay between the impact timing and the key-on timing. The central processing unit 201 checks the table to determine when the hammer assembly 13 is to reach the associated strings 15 in the silent performance, and generates a piece of music data information representative of the key-on timing delayed from the impact timing. An equation and coefficients may be used for determining the key-on timing. Thus, the key-on timing is identical between the standard performance and the silent performance.

Subsequently, the central processing unit 201 checks the instructions to see whether or not the pianist requested the recording system 21 to supply the pieces of normalized music data information to the outside thereof as by step S35. If the recording system 21 was requested to supply the pieces of normalized music data information to the outside, the answer at step SP35 is affirmative, and the central processing unit 201 instructs the normalizing unit 21*d* to form the pieces of music data information into the data formats defined in the MIDI (Musical Instrument Digital Interface) standards as by step S36. The MIDI formats contain a key code, a note-on containing a velocity and a note-off. On the contrary, when the recording system 21 was not instructed to supply the pieces of music data information to the outside, the answer at step S35 is negative, and the central processing unit 201 proceeds to step S37 without execution of step S36.

The central processing unit 201 checks the instructions to see whether or not the pianist requested the normalizing unit 21*d* to store the pieces of normalized music data information in the data storage as by step S37. If the pianist did not want any recording, the answer at step S37 is negative, and the central processing unit 201 returns to step S32. On the other hand, if the pianist wanted the normalizing unit 21*d* to store the pieces of normalized music data information in the data storage, the answer at step S37 is affirmative, and the central processing unit 201 proceeds to step S38 for recording the pieces of normalized music data information. Thereafter, the central processing unit 201 returns to step S32, and reiterates the loop consisting of steps S32 to S38.

Step S38 is detailed as follows. While the pianist is playing the tune on the keyboard 11 in the recording mode, the key sensors 21*b* and the hammer sensors 21*a* monitor the associated black/white keys 11*a*/11*b* and the associated hammer assemblies 13, and periodically supply the key position signals KP and the hammer position signals HP to the recording unit 21*c*.

The recording unit 21*c* checks the key position signals KP to see whether or not the pianist depresses any black/white keys 11*a*/11*b* and whether or not the pianist releases the depressed black/white keys. When one of the black/white keys 11*a*/11*b* is depressed and, thereafter, released, the recording unit 21*c* determines the depressing time, the depressed key velocity, the releasing time and the released key velocity, and generates pieces of music data information representative of them. The releasing time is corresponding to the note-off defined in the MIDI standards. The central processing unit 201 corrects the current key position Y' to the corrected key position Y" before the generation of the pieces of music data information. By virtue of the correction, the central processing unit 201 exactly determines the depressing time at the predetermined key position on the trajectory of the black/white key 11*a*/11*b,* and generates the pieces of music data information representative of the depressed key motion at the depressing time. The central processing unit 201 generates the pieces of music data information representative of the note-on at the impact time. The central processing unit 201 records the pieces of music data information corresponding to the key-code assigned to the depressed black/white key 11*a*/11*b,* the note-on and the velocity for the depressed black/white key 11*a*/11*b*.

If another key depressing, another note-on data or another note-off data has been already recorded, the central processing unit 201 calculates the lapse of time from the previous key depressing, the previous note-on or the previous note-off, and records the lapse of time as "duration" together with the pieces of music data information. Pieces of music data information relating to the key depressing, the note-on and the note-off are called as "event data", and the central processing unit 201 successively writes the event data into the random access memory 203 so as to record the performance.

Playback Operation

Figure 8:
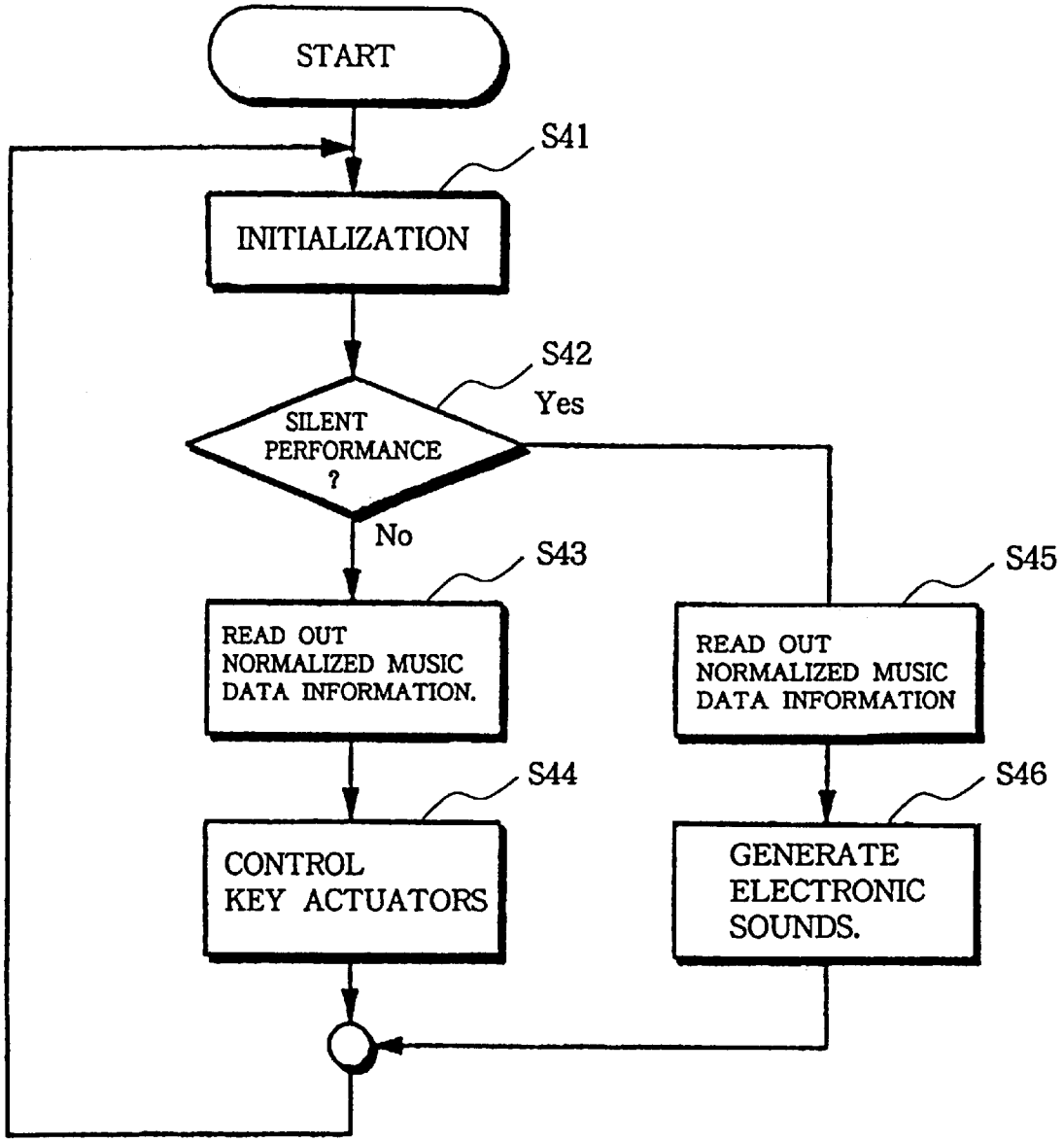
FIG. 8 is a flowchart showing a computer program for a playback.

When the automatic playing system 20 is instructed to reproduce the performance, the central processing unit 201 behaves as shown in FIG. 8. Assuming now that the pianist instructs the automatic playing system 20 to reproduce the performance already recorded, various instructions are given to the automatic playing system 20 through the switch board 204, and the central processing unit 201 starts the computer program at "START".

The central processing unit 201 firstly initializes registers, and establishes the playback sub-system 22 in the standard performance mode as by step S41. A tempo for the automatic playing is given to the playback sub-system 22 during the initialization.

Subsequently, the central processing unit 201 checks the instructions to see whether or not the pianist requests the silent performance to the automatic playing system as by step S42. If the pianist instructed the automatic playing system 20 to reproduce the acoustic tones, the answer at step S42 is negative, and the central processing unit 201 transfers the pieces of normalized music data information from the data storage to the random access memory 203 as by step S43. The pieces of normalized music data information are successively read out from the random access memory 203. The data read-out is carried out through an interruption routine, and a tempo clock representative of the tempo gives timings for the interruption. In this instance, the interruption takes place twenty-four times per a quarter note.

Assuming now that a piece of normalized music data information representative of an event accompanied with a duration data has been already read out from the random access memory 203, the central processing unit 201 decrements the duration data in synchronism with the tempo clock. When the duration data is decreased to zero, the central processing unit 201 reads out a piece of normalized music data information representative of the next event. Thus, the pieces of normalized music data information are read out in order of events. The central processing unit 201 repeats the data read-out, and determines the trajectories of the black/white keys 11*a*/11*b*, i.e., the target key velocity Vr varied with time.

The central processing unit 201 further determines the target key velocity Vr at each key position on the trajectory, and supplies it to the servo-controller 22*c*, and the servo-controller 22*c* energizes the solenoid-operated key actuators 22*d* as by step S44. In detail, the servo-controller 22*c* determines the magnitude of the driving signal DR corresponding to the given target key velocity Vr. The servo-controller 22*c* supplies the driving signal DR to the solenoid-operated key actuator 22*d* associated with the black/white key 11*a*/11*b* to be driven, and the solenoid-operated key actuator 22*d* projects the plunger so as to push up the rear portion of the black/white key 11*a*/11*b*. The black/white key 11*a*/11*b* actuates the associated key action mechanism 12, and the hammer assembly 13 escapes from the jack 12*b* of the key action mechanism 12. Then, the hammer assembly 13 starts the free rotation, and strikes the associated set of strings 15. The set of strings vibrates, and produces the acoustic tone. The hammer assembly 13 rebounds on the set of strings 15, and returns to the initial position. While the solenoid-operated key actuator 22*d* is projecting the plunger, the built-in velocity sensor supplies the feedback signal representative of the actual velocity Vy to the servo-controller 22*c*. The servo-controller 22*c* compares the actual velocity Vy with the target key velocity Vr, and regulates the driving signal DR.

A delay time is unavoidable between the supply of power to the key actuator 22*d* and the strike with the hammer assembly 13. This means that the sound generation is delayed from the read-out of an event frame. Moreover, the delay time is varied depending upon the hammer velocity. This results in irregular time intervals between the generations of acoustic tones. The same problem is encountered in the releases of the black/white keys 11*a*/11*b*. In order to equalize the time intervals, the playback sub-system 22 introduces a constant time delay between the read-out of an event frame and the motion represented by the event frame, i.e., a strike with the hammer assembly 13 or a damp of the vibrations with the damper head 14*b*. In this instance, the constant time delay is 500 milliseconds. When an event frame is read out from the memory, the central processing unit 201 determines a trajectory of the black/white key 11*a*/11*b* to be depressed and, thereafter, a certain timing when the solenoid-operated key actuator is to start the key motion. As a result, the hammer assembly 13 strikes the strings 15 and the damper head 14*b* damps the vibrations of the strings 15 500 milliseconds after the read-out of the event frame. Thus, the playback sub-system 22 keeps the time intervals between the events equal to the duration data.

On the other hand, if the pianist instructed the silent performance to the automatic playing system 20, the answer at step S42 is affirmative, and the pieces of normalized music data information are sequentially read out from the random access memory 203 as by step S45. The data read-out at step S45 is similar to the data read-out at step S43, and is carried out through the interruption routine.

The pieces of normalized music data information are supplied to the tone generator 30*c*, and the tone generator 30*c* produces the audio signal from the pieces of normalized music data information. The audio signal is supplied to the headphone 30*d* and/or a speaker system 30*e*, and electronic sounds are generated through the headphone 30*d* and/or the speaker system 30*e* as by step S46. In detail, the pieces of normalized music data information representative of the key code, the note-on, the velocity and the note-off are supplied to the tone generator 30*c*, and the tone generator 30*c* generates tone signals through plural channels thereof. The tone signals are mixed with each other so as to produce the audio signal. The pianist can selects another timbre of the electronic sounds through the manipulating board (not shown).

As will be understood from the foregoing description, the automatic player piano according to the present invention stores the corrected positional data Yend' at the end position and the corrected positional data Yrest' at the rest position for each black/white key 11*a*/11*b*. Those positional data Yend' and Yrest' are used for the correction of the current key position. The automatic player piano eliminates the individualities of the black/white keys 11*a*/11*b* from the digital key position signal KP representative of the current key position, and exactly determines the current key position on the trajectory of each key 11*a*/11*b*. This results in the enhancement of the accuracy of the music data information.

Figure 5:
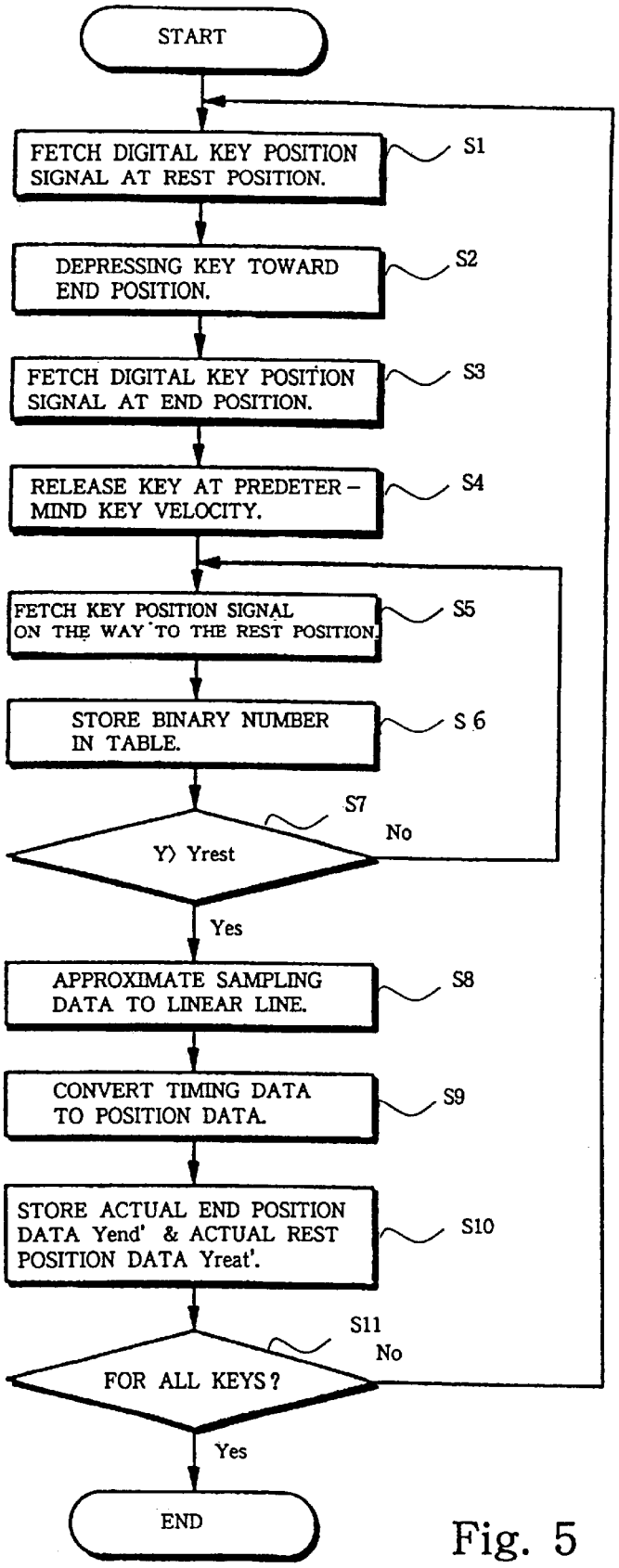
FIG. 5 is a flowchart showing a computer program for a calibration of black/white keys.

The automatic player piano carries out the calibration by itself as shown in FIG. 5. This means that user can calibrate them after delivery of the product from the factory. Thus, the automatic player piano according to the present invention is free from the aged deterioration.

Second Embodiment

An automatic player piano implementing the second embodiment is similar to that of the first embodiment except for calibration and data correction during a recording mode. For this reason, the description is focused on the calibration and the data correction. The components of the automatic playing system implementing the second embodiment are labeled with the references designating corresponding components of the first embodiment in the following description.

Figure 9:
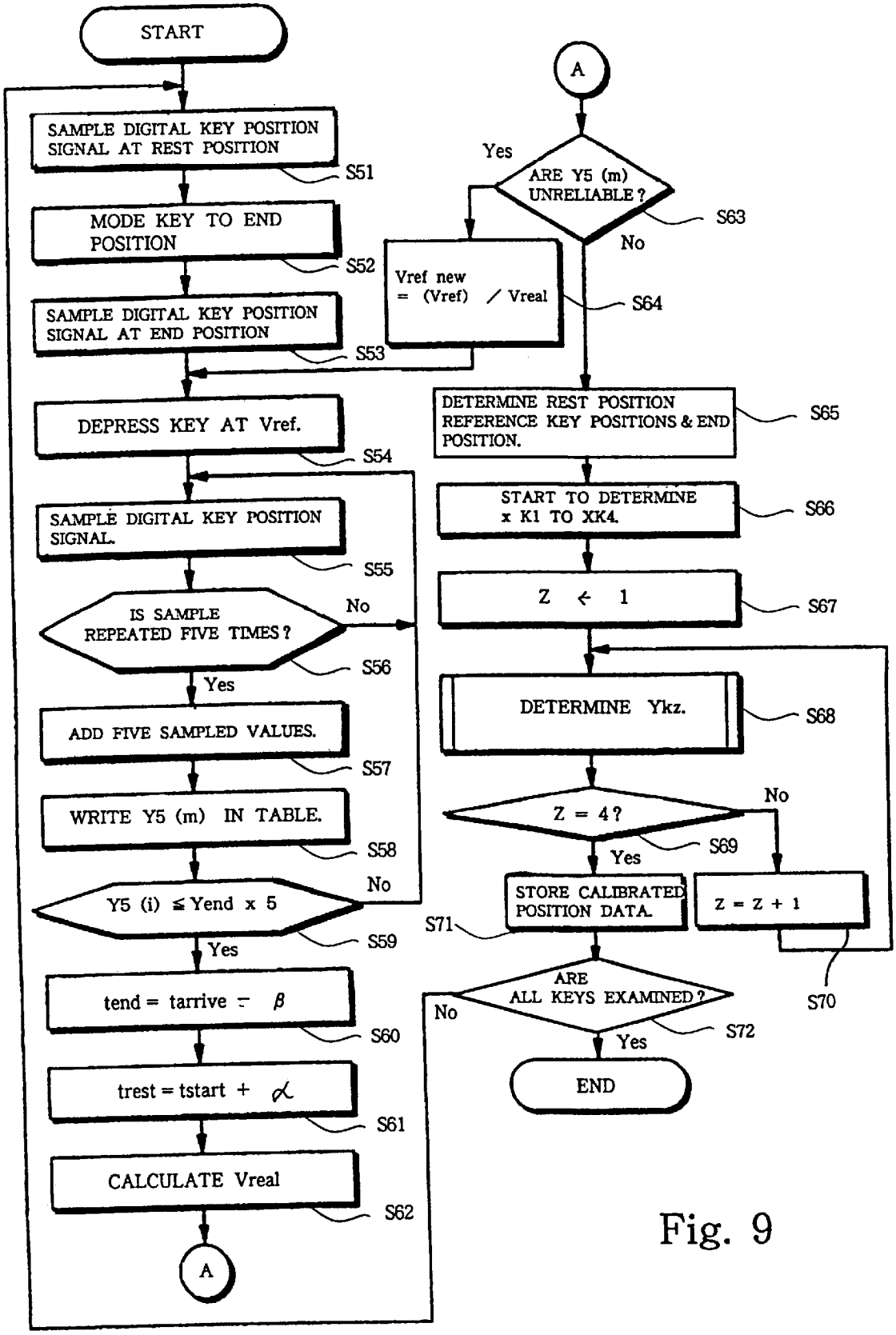
FIG. 9 is a flowchart showing a computer program for a calibration carried out in another automatic player piano according to the present invention.

Assuming now that the black/white keys 11*a*/11*b* have a standard stroke of 10 millimeters, the central processing unit 201 starts the calibration at "START" (see FIG. 9). The central processing unit 201 instructs the driver 206 to energize the light emitting diode 21*g* associated with selected one of the black/white keys 11*a*/11*b*, and samples the digital key position signal KP at the rest position. The sampled value of the digital key position signal KP is transferred to the random access memory 203 as by step S51, and is stored as a piece Yrest of positional data information.

Subsequently, the selected black/white key 11*a*/11*b* is depressed, and is moved to the end position as by step S52. The selected black/white key 11*a*/11*b* is maintained at the end position. The central processing unit 201 instructs the driver 206 to energize the associated light emitting diode 21*g*, and samples the digital key position signal KP at the end position as by step S53. The central processing unit 201 also transfers the sampled value of the digital key position signal KP to the random access memory 203, and stores the sampled value in the random access memory 203 as a piece Yend of positional data information.

Subsequently, the selected black/white key 11*a*/11*b* is allowed to return to the rest position. The central processing unit 201 determines a trajectory to be traced by the selected black/white key 11*a*/11*b*, and instructs the servo-controller 208 to move the selected black/white key 11*a*/11*b* at a predetermined depressed key velocity Vref as by step S54. In this instance, the predetermined depressed key velocity Vref is 10 millimeters/second.

When the selected black/white key 11*a*/11*b* starts from the rest position toward the end position, the central processing unit 201 instructs the driver 206 to continuously energize the associated light emitting diode 21*g*, and samples the digital key position signal KP as by step S55. The central processing unit 201 transfers the sampled value of the digital key position signal KP to the random access memory 203, and stores the sampled value at a starting time tstart=0. The central processing unit 201 checks the random access memory 203 to see whether or not the sampling is repeated five times as by step S56. If the answer at step S56 is negative, the central processing unit 201 returns to step S55, and repeats the sampling. Thus, the central processing unit 201 repeats the sampling at sampling intervals of 10 millisecond, and stores the sampled values of the digital key position signal KP in the random access memory 203 at respective sampling times t.

When the central processing unit 201 finds five pieces of positional data information in the random access memory 203, the answer at step S56 is affirmative, and the central processing unit 201 adds the five sampled values as by step S57. The digital key position signal KP is assumed to have a value Ym at a sampling time t(m). Other four values Y(m−2), Y(m−1), Y(m+1), Y(m+2) of the digital key position signal KP are sampled at the sampling times t(m−2), t(m−1), t(m+1), t(m+2), respectively, and the central processing unit 201 adds the five sampled values Y(m−2), Y(m−1), Y(m), Y(m+1), Y(m+2) to one another. The central processing unit 201 determines the sum to be the piece Y5(m) of positional data information at the sampling time t(m), and writes the piece Y5(m) of positional data information in a table together with the sampling timing t(m) as by step S58. Y5(i) is representative of a piece of positional data information at an arbitrary sampling time t(i), and index i is t/10 where the sampling intervals t is 10 milliseconds. The piece Y5(i) of positional data information is representative of a kind of positional data information between −0.2 millimeter and +0.2 millimeter. The central processing unit 201 divides the piece Y5(i) of positional data information at each sampling time by five upon completion of the sampling operation. Thus, the five sampled values Y(m−2), Y(m−1), Y(m), Y(m+1), Y(m+2) are finally averaged. The five sampled values Y(m−2), Y(m−1), Y(m), Y(m+1), Y(m+2) may be divided by five and, thereafter, simply added so as to obtain the mean value Y5(m) representative of the piece of positional data information. However, the pieces Y5(i) of positional data information are desirable from the viewpoint of accuracy.

Subsequently, the central processing unit 201 multiples the piece of positional data information Yend by five, and checks the piece Y5(i) of positional data information just stored at step S58 to see whether or not the product 5Yend is equal to or greater than the piece Y5(i) of positional data information, i.e., Y5(m)≦Yend×5 as by step S59.

If the selected black/white key 11*a*/11*b* is still on the way to the end position, the answer at step S59 is given negative, and the central processing unit 201 returns to step S55. Thus, the central processing unit 201 reiterates the loop consisting of steps S55 to S59 until the selected black/white key 11*a*/11*b* arrives at the end position, and writes pieces Y5(i) of positional data information together with the sampling timing t(i).

When the selected black/white key 11*a*/11*b* arrives at the end position, the answer at step S59 is affirmative, and the central processing unit 201 determines an arrival time tarrive to be equal to the t(i) when the piece Y5(i) of positional data information is determined to be equal to the product 5Yend. Then, the central processing unit subtracts a correction factor β from the arrival time tarrive, and determines a quasi arrival time tend to be equal to the difference, i.e., tend=tarrive−β as by step S60. The correction factor β compensates the arrival time for a time lag due to the deceleration of the selected black/white key 11*a*/11*b* in the vicinity of the end position. The correction factor β is determined through an experiment.

Subsequently, the central processing unit 201 adds another correction factor α to the starting time tstart, and determines a quasi starting time trest to be equal to the sum, i.e., trest=tstart+α as by step S61. The correction factor α compensates the starting time for a time lug due to an acceleration of the selected black/white key 11*a*/11*b*, and is determined through an experiment. By virtue of the correction factors α and β, the key motion is assumed to be a uniform motion from the rest position to the end position.

Subsequently, the central processing unit 201 calculates a key velocity Vreal in the uniform motion as by step S62. The key velocity Vreal is given as $$V\text{real}=10\times1000/(t\text{end}-t\text{rest})[\text{mm/second}]$$

The central processing unit checks the key velocity Vreal to see whether the pieces Y5(m) of positional data information are unreliable as by step S63. If the key velocity Vreal is less than a half of the predetermined key velocity Vref, i.e., Vreal<Vref×0.5 or greater than half as much again as the predetermined key velocity Vref, i.e., Vreal>Vref×1.5, the central processing unit decides the pieces Y5(m) of positional data information to be unreliable.

If the key velocity Vreal is widely different from the predetermined key velocity Vref, the answer at step S63 is affirmative, and the central processing unit 201 determines a new key velocity $Vref_{new}$ as by step S64. Using the new key velocity $Vref_{new}$ as the predetermined key velocity Vref, the central processing unit 201 repeats the loop consisting of steps S54 to S62.

When the key velocity Vref falls within the range between a half of the predetermined key velocity Vref and half as much again as the predetermined key velocity Vref, the answer at step S63 is negative, and the central processing unit 201 determines the rest position Xrest, the first reference key position Xk1, the second reference key position Xk2, the third reference key position Xk3, the fourth reference key position Xk4 and the end position Xend (see FIG. 4) as by step S65. In this instance, the first reference key position Xk1 to the fourth reference key position Xk4 are located at 27 percent, 45 percent, 63 percent and 81 percent of the key stroke. The distance from the rest position is calculated as Rest position: Xrest=0.0 mm First reference key position: Xk1=2.7 mm Second reference key position: Xk2=4.5 mm Third reference key position: Xk3=6.3 mm Fourth reference key position: Xk4=8.1 mm End position: Xend=10.0 mm Subsequently, the central processing unit 201 starts to determine the first reference key position Xk1 to the fourth reference key position Xk4 at step S66. The first reference key position Xk1 to the fourth reference key position Xk4 are determined through an interpolation. In detail, the reference key position is representative of Xkz where z is 1, 2, 3 and 4. First, the central processing unit 201 gives "1" to z as by step S67.

Subsequently, the central processing unit 201 determines the piece of positional data information Ykz as by step S68. Firstly, the central processing unit 201 calculates the time tkz at which the selected black/white key 11*a*/11*b* arrives at the first reference key position Xkz.

$$tkz=(t\text{end}-t\text{rest})\times Xkz/(X\text{end}-X\text{rest})+t\text{rest}$$

Subsequently, the central processing unit 201 searches the table for the pieces Y5kza and Y5kzb of positional data information. The piece Y5kza has the minimum value in the pieces of positional data information greater in value than the piece Ykz of positional data information, and the other piece Y5kzb has the maximum value in the pieces of positional data information not greater in value than the piece Ykz of positional data information. For this reason, the pieces YSkza/ Y5kzb are expressed as $$Y5kza=Y5[tkz/10+1]$$

$$Y5kzb=Y5[tkz/10]$$

Finally, the central processing unit 201 determines the value of the piece Ykz of positional data information through the interpolation as follows.

$$Ykz=(Y5kzb+(Y5kza-Y5kzb)\times(tkz\%10)/10)/5$$

where the operator % is representative of a remainder on division of the left term by the right term.

Subsequently, the central processing unit 201 checks the random access memory 203 to see whether "z" is four as by step S69. When the central processing unit 201 determines the pieces of positional data information representative of the first reference key position Yk1, the second reference key position Yk2 and the third reference key position Yk3, the answer at step S69 is negative, and the central processing unit 201 increments the value of z by one as by step S70. Thereafter, the central processing unit 201 returns to step S68. Thus, the central processing unit 201 reiterates the loop consisting of steps S68 to S70 so as to determine the pieces of positional data information representative of the first reference key position Yk1, the second reference key position Yk2, the third reference key position Yk3 and the fourth reference key position Yk4.

When the central processing unit determined the pieces of positional data information representative of the fourth reference key position Yk4, the answer at step S69 is affirmative, and the central processing unit 201 stores the pieces of positional data information representative of the end position Yend, the rest position Yrest, the first reference key position Yk1, the second reference key position Yk2, the third reference key position Yk3 and the fourth reference key position Yk4 in the table as calibrated position data at step S71.

Subsequently, the central processing unit 201 checks the random access memory 203 to see whether or not all the black/white keys 11*a*/11*b* have been already calibrated as by step S72. While there is a non-selected black/white key 11*a*/11*b*, the answer at step S72 is negative, and the central processing unit 201 returns to step S51. The central processing unit 201 changes the selected black/white key 11*a*/11*b* to the next one, and repeats the loop consisting of steps S51 to S72. Thus, the central processing unit 201 reiterates the loop consisting of steps S51 to S72 for calibrating all the black/white keys 11*a*/11*b*.

When the central processing unit calibrated all the black/white keys 11*a*/11*b*, the answer at step S72 is changed to affirmative, and the central processing unit 201 terminates the computer program at "END".

Figure 10:
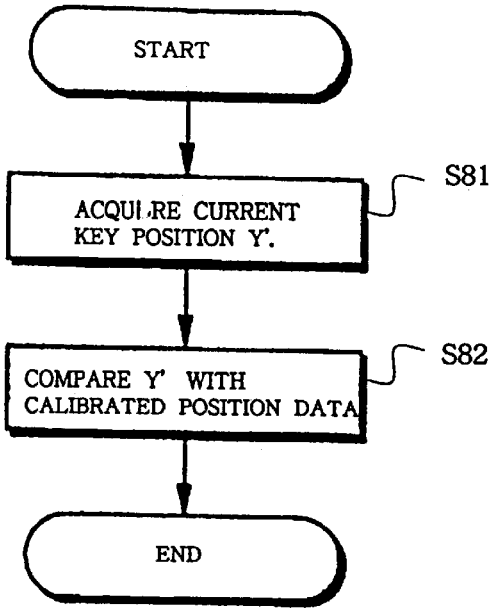
FIG. 10 is a flowchart showing a computer program for a correction of positional data information in the recording operation.

Using the calibrated positional data, the automatic playing system 20 corrects pieces of positional data information representative of current key positions as shown in FIG. 10.

Assuming now that a pianist is recording a performance, the fingers selectively depress the black/white keys 11*a*/11*b*, and the associated key action mechanisms 12 drive the associated hammer assemblies 13 for rotation. The hammers strike the associated sets of strings 15, or rebound on the hammer stopper 30*a*. The key sensors 21*b* monitor the associated black/white keys 11*a*/11*b* during the performance, and the central processing unit 201 periodically fetches the.digital key position signals KP representative of current key positions Y' as by step S81.

Subsequently, the central processing unit 201 compares the piece of positional data information representative of the current key position Y' with the calibrated position data to see whether or not the black/white key 11*a*/11*b* reaches the rest position, the end position, the first reference key position K1, the second reference key position K2, the third reference key position K3 or the fourth reference key position K4 as by step S82. When the central processing unit 201 determines the black/white key 11*a*/11*b* to arrive at one of the rest position, the end position, the first reference key position K1, the second reference key position K2, the third reference key position K3 or the fourth reference key position K4, the central processing unit 201 starts given jobs for generating pieces of music data information.

As will be understood from the foregoing description, the automatic player piano has the table of the calibrated position data, and accurately determines the key motions on the basis of the calibrated position data without being influenced by the individuality of the black/white keys 11*a*/11*b*. The automatic playing system 20 per se carries out the calibration, and the calibration is repeatable after the delivery to user. Thus, the automatic player piano eliminates aging related deterioration from the pieces of music data information representative of a performance.

Third Embodiment

Yet another automatic player piano implementing the third embodiment is similar to the second embodiment except for a calibration of black/white keys 11*a*/11*b* and a data correction in a recording operation. Description is focused on the calibration and the data correction carried out in the automatic player piano. In the second embodiment, the black/white keys 11*a*/11*b* are depressed at the predetermined key velocity Vref, and the automatic playing system 20 samples the digital key position signals KP at the predetermined intervals. The automatic player piano implementing the third embodiment uses special jigs in the calibration.

Figure 11A:
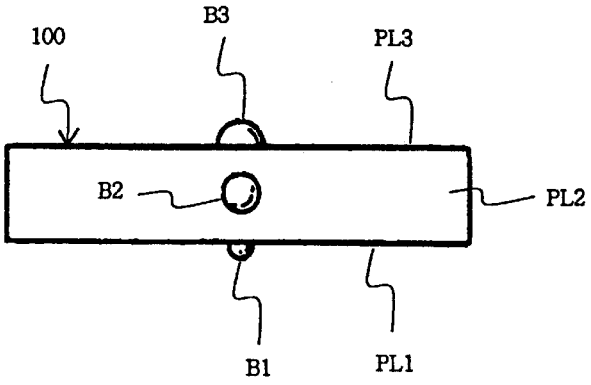
FIGS. 11A and 11B are a front view and a side view showing a jig used in a calibration of keys.
Figure 11B:
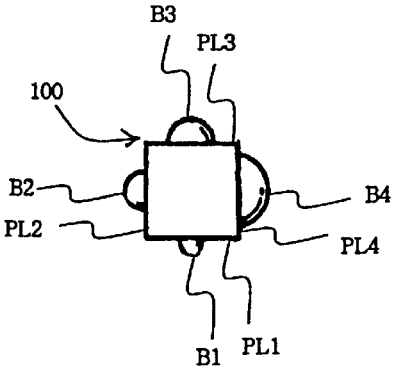

FIGS. 11A and 11B illustrate a jig used in the calibration of the black/white keys 11*a*/11*b*. Four semi-spherical projections B1, B2, B3 and B4 are embedded in a base member 100. The base member 100 has a rectangular parallelepiped configuration, and four surfaces are finished so as to serve as reference surfaces PL1, PL2, PL3 and PL4. The semi-spherical projections B1, B2, B3 and B4 are different in size, and the distances between the reference surfaces PL and the semi-spherical projections B1/B2/B3/B4 are adjusted to the distances from the rest position to the first reference key position K1, the second reference key position K2, the third reference key position K3 and the fourth reference key position K4, respectively.

When a tuner depresses a black/white key 11*a*/11*b* to the second reference key position K2, the reference surface PL2 is placed on the upper surfaces of the adjacent black/white keys 11*a*/11*b*, and the semi-spherical projection B2 is pressed against the upper surface of the black/white key 11*a*/11*b*. Then, the black/white key 11*a*/11*b* is downwardly moved, and is maintained at the second reference key position K2.

Figure 12:
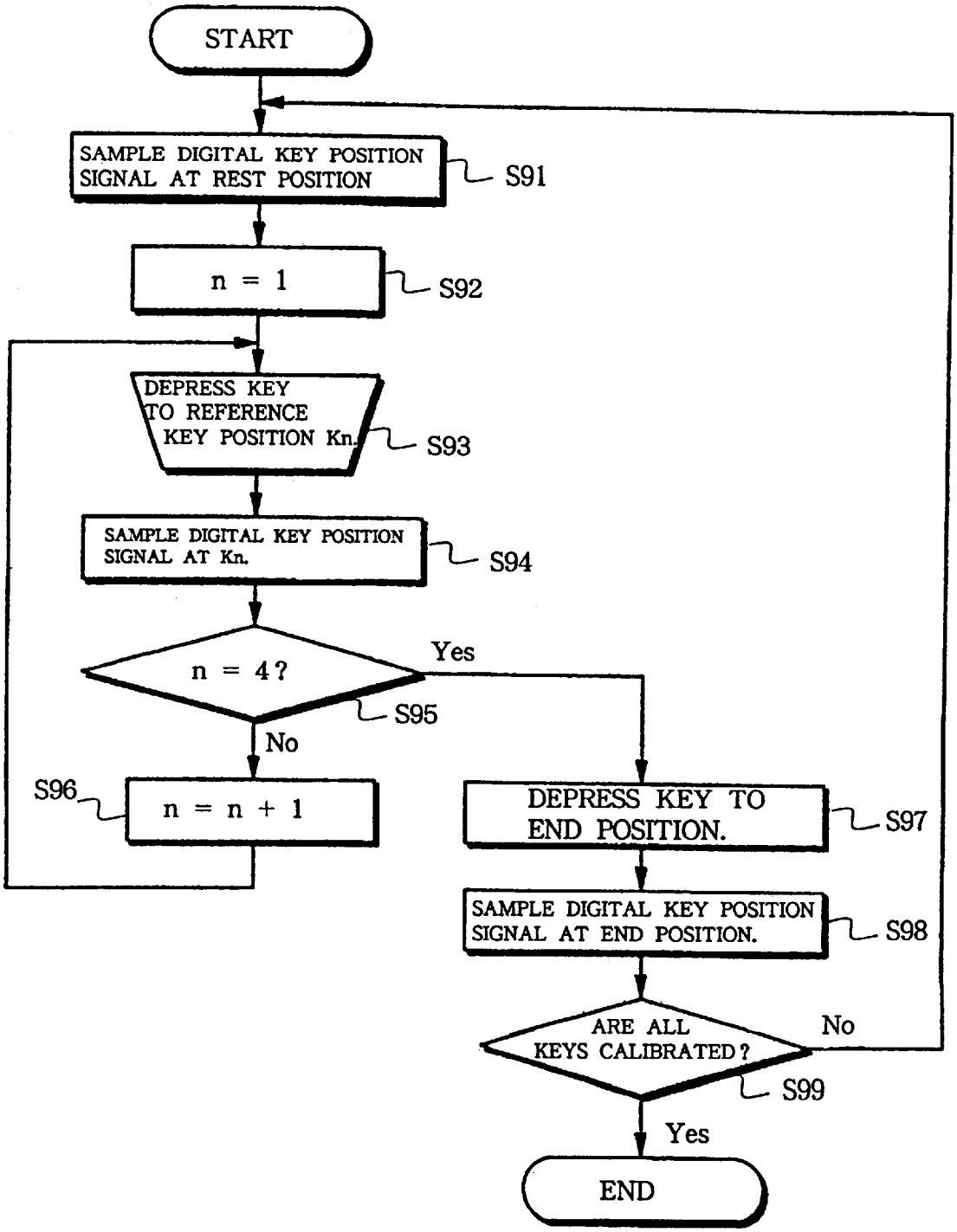
FIG. 12 is a flowchart showing a computer program for a calibration of keys.

FIG. 12 illustrates a calibration of the black/white keys 11*a*/11*b* carried out in the automatic player piano implementing the third embodiment. The keystroke is assumed to be 10 millimeters. The reference key positions are expressed as Kn where n is 1, 2, 3 and 4.

First, the automatic playing system 20 selects one of the black/white keys 11*a*/11*b*, and keeps the selected black/white key 11*a*/11*b* at the rest position. The central processing unit 201 samples the digital key position signal KP, and stores the value of the digital key position signal KP in a table as a piece Yrest of positional data information as by step S91.

Subsequently, the central processing unit 201 gives "1" to the index n as by step S92. Using the jig, the selected black/white key 11*a*/11*b* is depressed to the reference key position Kn as by step S93, and the central processing unit 201 samples the digital key position signal KP at the reference key position Kn as by step S94. The central processing unit 201 stores the value of the digital key position signal KP as a piece Ykn of positional data information in the table.

Subsequently, the central processing unit 201 checks the index n to see whether or not the digital key position signal KP was sampled at the fourth reference key position K4 as by step S95. When the central processing unit 201 sampled the digital key position signal KP at the first reference key position K1, the second reference key position K2 or the third reference key position K3, the answer at step S95 is negative, and the central processing unit 201 returns to step S93. Thus, the central processing unit 201 repeats the loop consisting of steps S93 to S96, and samples the digital key position signal KP at the first reference key position K1, the second reference key position K2, the third reference key position K3 and the fourth reference key position K4. The sampled values are stored in the table as pieces Yk1, Yk2, Yk3 and Yk4 of positional data information.

When the central processing unit 201 sampled the digital key position signal KP at the fourth reference key position K4, the answer at step S95 is affirmative, and the central processing unit 201 moves the selected black/white key 11*a*/11*b* to the end position as by step S97. The central processing unit 201 samples the digital key position signal KP at the end position as by step S98, and stores the sampled value in the table as a piece Yend of positional data information.

The central processing unit 201 checks the table to see whether or not all the black/white keys 11*a*/11*b* have been already calibrated as by step S99. If there is a non-selected black/white key 11*a*/11*b*, the central processing unit 201 changes the black/white key 11*a*/11*b* to be calibrated to the next one, and returns to step S91. Thus, the central processing unit repeats the loop consisting of steps S91 to S99 for all the black/white keys 11*a*/11*b*, and stores the pieces Yrest, Yk1, Yk2, Yk3, Yk4 and Yend of positional data information in the table. When the table is completed, the answer at step S99 is affirmative, and the central processing unit 201 terminates the computer program at "END".

Figure 13:
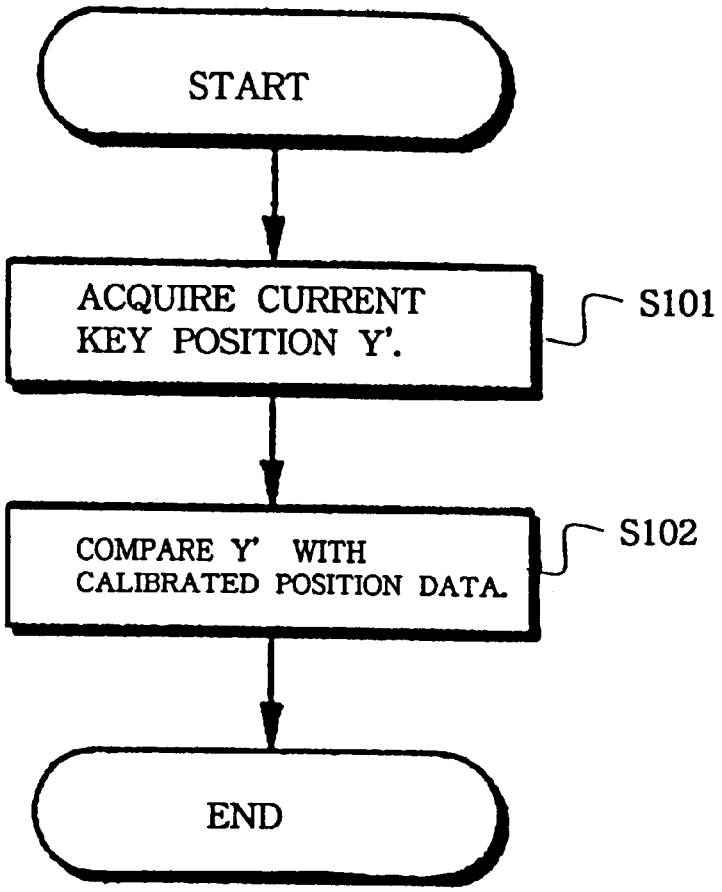
FIG. 13 is a flowchart showing a computer program for a data correction carried in the recording mode.

Using the calibrated positional data, the automatic playing system 20 corrects pieces of positional data information representative of current key positions as shown in FIG. 13.

Assuming now that a pianist is recording a performance, the fingers selectively depress the black/white keys 11*a*/11*b*, and the associated key action mechanisms 12 drive the associated hammer assemblies 13 for rotation. The hammers strike the associated sets of strings 15, or rebound on the hammer stopper 30*a*. The key sensors 21*b* monitor the associated black/white keys 11*a*/11*b* during the performance, and the central processing unit 201 periodically fetches the digital key position signals KP representative of current key positions Y' as by step S101.

Subsequently, the central processing unit 201 compares the piece of positional data information representative of the current key position Y' with the calibrated position data to see whether or not the black/white key 11*a*/11*b* reaches the rest position, the end position, the first reference key position K1, the second reference key position K2, the third reference key position K3 or the fourth reference key position K4 as by step S102. When the central processing unit 201 determines the black/white key 11*a*/11*b* to arrive at one of the rest position, the end position, the first reference key position K1, the second reference key position K2, the third reference key position K3 or the fourth reference key position K4, the central processing unit 201 starts given jobs for generating pieces of music data information.

As will be understood from the foregoing description, the automatic player piano has the table of the calibrated position data, and accurately determines the key motions on the basis of the calibrated position data without being influenced by the individuality of the black/white keys 11*a*/11*b*. The usage of the jig makes the calibration easy, and the black/white keys 11*a*/11*b* are easily calibrated after delivery to user. Thus, the automatic player piano eliminates age-based deterioration from the pieces of music data information.

As will be appreciated from the foregoing description, the keyboard musical instrument according to the present invention calibrates the keys and/or pedals, and determines the current positions through the comparison between the current positions detected by the non-contact type position sensors and the calibrated position data. As a result, the keyboard musical instrument accurately recognizes the key/pedal motions during a performance.

The non-contact type position sensor is economical, and the manufacturer thereof reduces the production cost. The calibration is carried out by the keyboard musical instrument per se. For this reason, the calibration is repeatable after delivery to user, and the age-based deterioration is eliminated from the determination of the key/pedal motions.

In the above-described embodiments, the black/white keys 11*a*/11*b* serve as plural manipulators, and the key action mechanisms 12, the hammer assemblies 13, the damper mechanisms 14, the sets of strings 15, tone generator 30*c* and the solenoid-operated actuators 22*d* as a whole constitute a sound generating system. The key sensors 21*b*, the driver 206, the analog-to-digital converter 207, the central processing unit 201 and the computer program shown in FIG. 5 or FIG. 9 as a whole constitute a position transducer system. The central processing unit 201, the servo-controller 208 and the computer programs shown in FIGS. 6 and 8 as a whole constitute a controller.

Although the particular embodiments of the present invention have been shown and described, it will be obvious to those skilled in the art that various changes and modifications may be made without departing from the spirit and scope of the present invention.

For example, the method for the calibration is available for pedals incorporated in the automatic player piano.

In the above-described embodiments, the automatic playing system 20 moves the black/white keys 11*a*/11*b* to the target key positions. However, the black/white keys 11*a*/11*b* may be moved by using any driving technology insofar as the driving technology achieves a uniform key motion. A high-speed servo-driving technology is one of them. A weight may be dropped onto a selected black/white key 11*a*/11*b* so as to move the key in a uniform motion.

Figure 14:
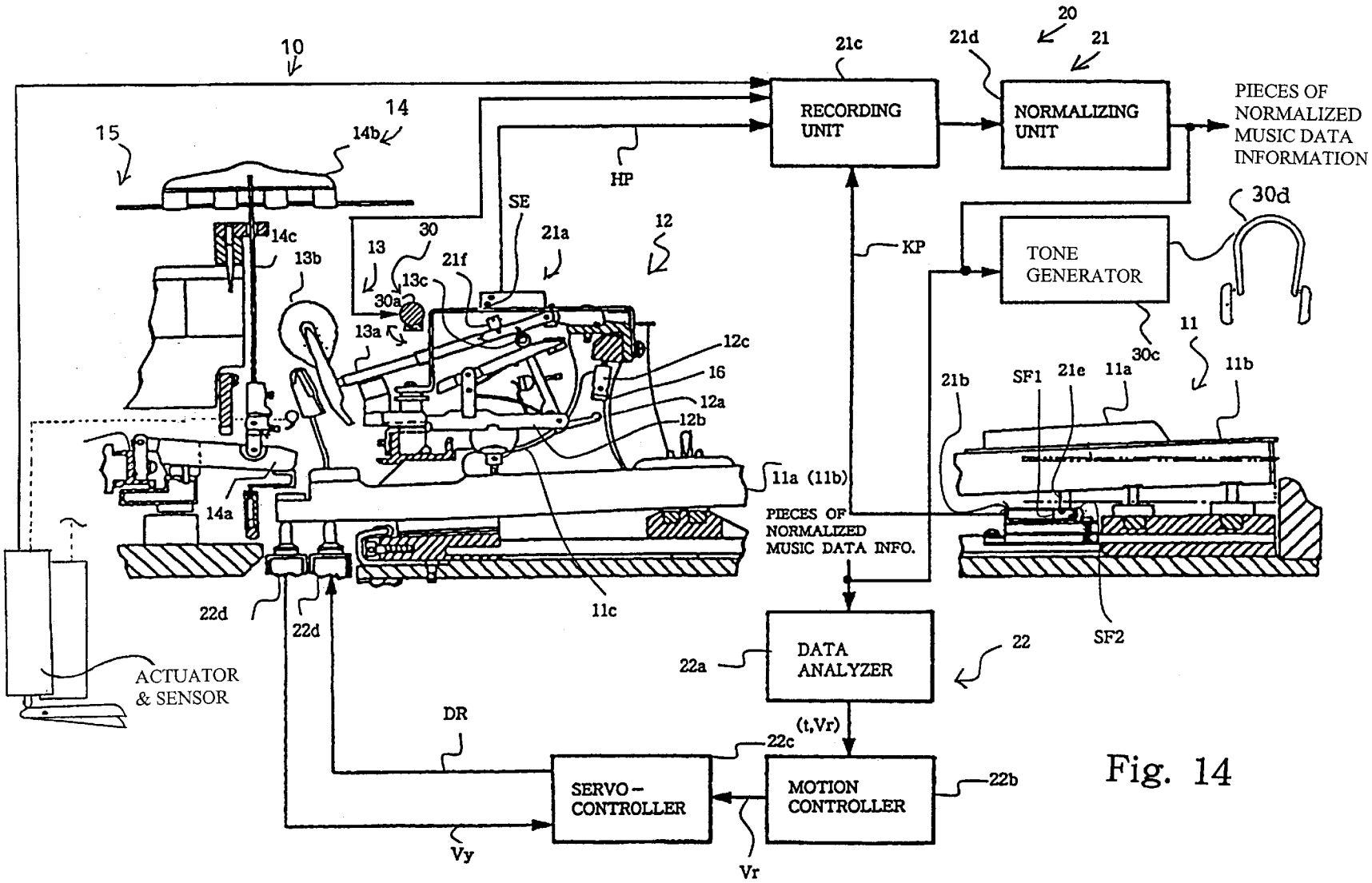
FIG. 14 is a schematic view showing a modification.

The position transducer system may be provided for pedal mechanisms as shown in FIG. 14.

The keyboard musical instrument according to the present invention is never limited to the silent automatic player piano. A keyboard musical instrument may be implemented by the combination of an acoustic piano and the automatic playing system or the combination of an acoustic piano and the silent system. An electric keyboard or another kind of compromise between an acoustic keyboard musical instrument and an electronic system.

What is claimed is:

1. A position transducer system for determining a current position of a moving object movable along a trajectory, comprising:

a non-contact type sensor monitoring said moving object, and converting the current position of said moving object to a signal;

a calibrator moving said movable object under standard conditions, connected to said non-contact type sensor, and analyzing said signal for determining a relation between values of said signal and actual positions of said moving object; and a corrector connected to said non-contact type sensor for receiving said signal, and determining said current position of said moving object on the basis of said relation.

2. The position transducer system as set forth in claim 1, in which said standard conditions contain a uniform motion of said moving object from one end of said trajectory to the other end of said trajectory.

3. The position transducer system as set forth in claim 2, in which said calibrator samples said signal at predetermined intervals during said uniform motion for determining a preliminary relation between said values and a lapse of time from a starting time of said uniform motion to a finishing time of said uniform motion, and converts said preliminary relation to said relation between said values and said actual positions.

4. The position transducer system as set forth in claim 3, in which said corrector converts said current key position to a quasi-current key position on a design trajectory, and said quasi-current key position is expressed as $$Y''=YD\text{rest}+(YD\text{end}-YD\text{rest})\times(Y'-Y\text{rest}')/(Y\text{end}'-Y\text{rest}')$$

where YDrest is a design value of said signal at said one end, YDend is a design value of said signal at said other end, Y' is an actual value of said signal at a certain point on said trajectory, Yrest' is the value of said signal at said one end stored in said relation and Yend' is the value of said signal at said other end stored in said relation.

5. The position transducer system as set forth in claim 2, in which said calibrator samples said signal at predetermined intervals, and averages the values of said signal at a predetermined number of sampling times on both sides of each sampling time so as to determine the value of said signal at said each sampling time.

6. The position transducer system as set forth in claim 5, in which said calibrator calculates an actual velocity of said moving object on the basis of said values of said signal and a lapse of time, and decides whether or not said values of said signal are reliable, if said actual velocity is widely different from the velocity of said uniform motion, said calibrator samples said signal under a different velocity of said moving object.

7. The position transducer system as set forth in claim 6, in which said calibrator further determines values of said signal representative of reference positions on said trajectory by using a proportional distribution.

8. The position transducer system as set forth in claim 1, in which said calibrator further determines values of said signal representative of reference positions on said trajectory, and said moving object is forcibly moved to said reference positions by using a jig.

9. A method for determining a current position of an object, comprising the steps of:

a) moving said object along a trajectory under standard conditions so as to obtain values of a signal representative of current positions on said trajectory;

b) determining a relation between said values of said signal and said current positions; and c) determining an actual position of said object moved under different conditions by comparing the value of said signal at said actual position with said values in said relation.

* * * * *